US010987946B2

(12) United States Patent
Maruta et al.

(10) Patent No.: US 10,987,946 B2
(45) Date of Patent: Apr. 27, 2021

(54) INK EJECTING DEVICE AND PRINTING APPARATUS

(71) Applicant: KYOCERA Document Solutions Inc., Osaka (JP)

(72) Inventors: Masaaki Maruta, Osaka (JP); Masato Usui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/417,163

(22) Filed: May 20, 2019

(65) Prior Publication Data

US 2019/0358964 A1 Nov. 28, 2019

(30) Foreign Application Priority Data

May 28, 2018 (JP) ..... JP2018-101595

(51) Int. Cl.
*B41J 3/407* (2006.01)
*B41J 2/165* (2006.01)
*B41J 11/00* (2006.01)

(52) U.S. Cl.
CPC ..... *B41J 3/4078* (2013.01); *B41J 2/165* (2013.01); *B41J 11/007* (2013.01); *B41J 2202/15* (2013.01)

(58) Field of Classification Search
CPC ..... B41J 2/16508; B41J 11/007; B41J 2/165; B41J 2202/15; B41J 3/4078
See application file for complete search history.

(56) References Cited

U.S. PATENT DOCUMENTS

| | | | | |
|---|---|---|---|---|
| 2008/0012884 | A1 | 1/2008 | Ben-Zur et al. | 347/2 |
| 2018/0215119 | A1* | 8/2018 | Kaji | B41F 5/24 |
| 2018/0264811 | A1* | 9/2018 | Hasegawa | B41J 2/16508 |
| 2019/0001668 | A1* | 1/2019 | Arakane | B41J 2/16508 |

FOREIGN PATENT DOCUMENTS

JP 2007-525339 A 9/2007

* cited by examiner

*Primary Examiner* — Jannelle M Lebron
(74) *Attorney, Agent, or Firm* — Stein IP, LLC

(57) ABSTRACT

An ink ejecting device includes: a head that ejects ink from a plurality of nozzles arranged along a Y-axis direction parallel to a direction in which a recording medium is conveyed; an X-axis moving mechanism that moves the head in an X-axis direction orthogonal to the Y-axis direction on the horizontal plane; a control unit that performs scanning in which the head is moved in the X-axis direction and that causes the head to eject ink during the scanning; and a Z-axis moving mechanism that moves the head in a Z-axis direction orthogonal to the Y-axis and X-axis directions.

4 Claims, 12 Drawing Sheets

INK EJECTING DEVICE AND PRINTING APPARATUS

INCORPORATION BY REFERENCE

This application is based upon and claims the benefit of priority to Japanese Application No. 2018-101595, filed on May 28, 2018, the entire contents of which are incorporated herein by reference.

BACKGROUND

Field of the Invention

This disclosure relates to an ink ejecting device and a printing apparatus that print on a recording medium.

Description of Related Art

In the related art, printing may be performed on a fabric material as a recording medium. When printing is performed on a fabric material, ink is applied to the fabric material. After being applied to the fabric material, the ink is fixed thereto. In printing on a fabric material, an inkjet printer may be used.

SUMMARY

An ink ejecting device according to a first aspect of this disclosure is installed on a conveyance line for a recording medium in a conveying device that conveys the recording medium, and is installed there together with a plate device that performs printing on the recording medium using a plate. The ink ejecting device includes a head, an X-axis moving mechanism, a control unit, and a Z-axis moving mechanism. The head performs printing on a recording medium by ejecting ink onto the recording medium from a plurality of nozzles arranged along the Y-axis direction. The Y-axis direction is parallel to a direction in which the recording medium is conveyed. The X-axis moving mechanism moves the head in an X-axis direction orthogonal to the Y-axis direction on a horizontal plane. The control unit controls the X-axis moving mechanism to perform scanning in which the head is moved in the X-axis direction, and causes the head to eject ink during the scanning. The Z-axis moving mechanism is controlled by the control unit and moves the head in the Z-axis direction orthogonal to the Y-axis and X-axis directions.

A printing apparatus according to a second aspect of this disclosure includes the ink ejecting device described above, a conveying device, and a plate device. The conveying device conveys a recording medium on which printing is to be performed by the ink ejecting device. The plate device performs printing on a recording medium using a plate.

DETAILED DESCRIPTION

Below, an ink ejecting device 1 of the present embodiment, and a printing apparatus 100 provided with the ink ejecting device 1 will be described with reference to FIGS. 1 to 16. The printing apparatus 100 includes a plate device 2. The plate device 2 is a fabric printing device. The ink ejecting device 1 and the plate device 2 print on a recording medium.

In the description below, fabric 7 is used as a recording medium. However, the type of the recording medium is not particularly limited. Materials usable for printing in both the ink ejecting device 1 and the plate device 2 may be employed as a recording medium. For example, the recording medium may be paper.

In the description below, a direction parallel to a conveyance direction of the fabric 7 is referred to as a Y-axis direction. A direction that orthogonally crosses the Y-axis direction on a horizontal plane is referred to as an X-axis direction. A direction orthogonally crosses the Y-axis direction and the X-axis direction is referred to as a Z-axis direction.

(Overall Configuration of Printing Apparatus)

Figure 1:
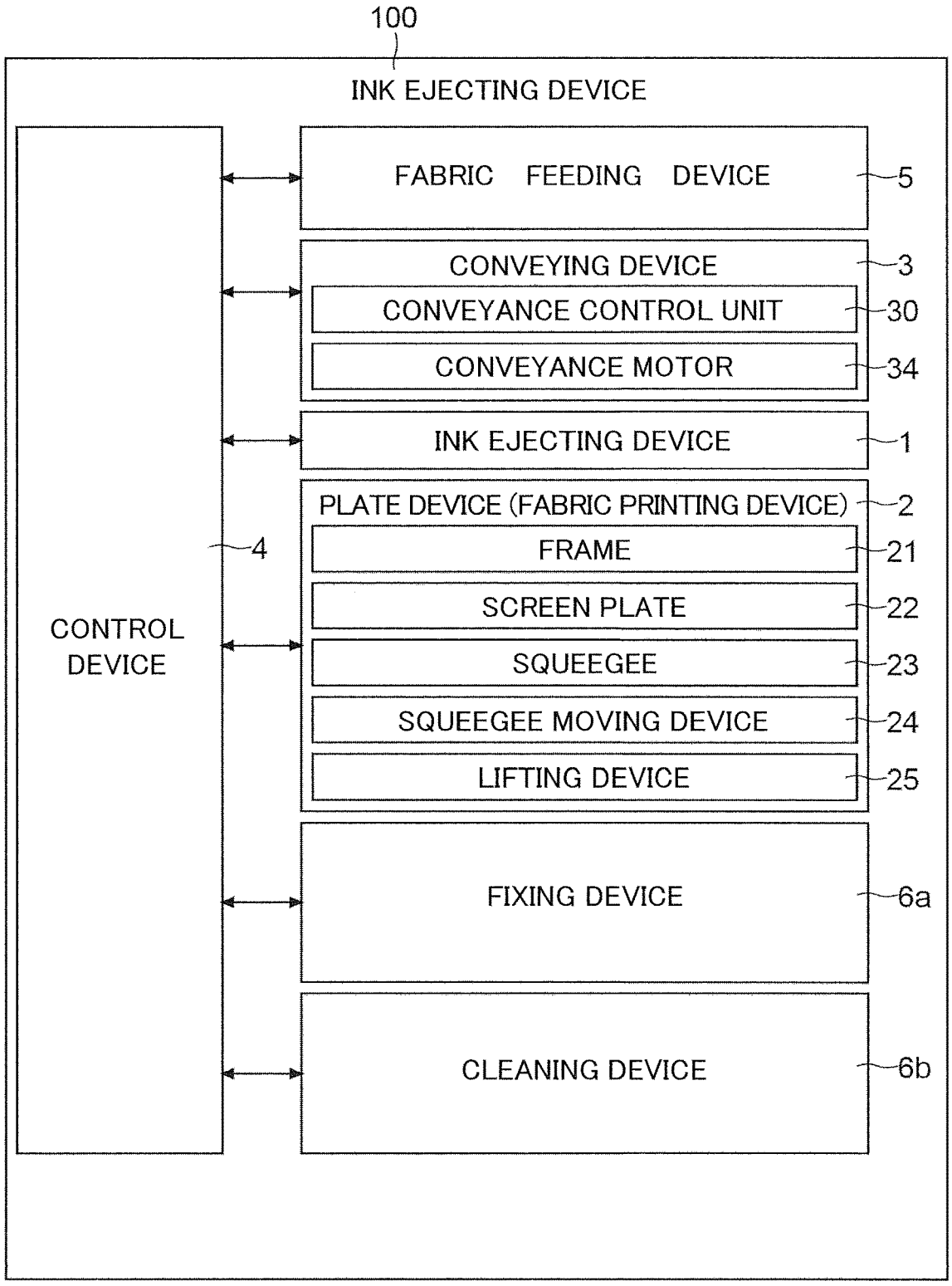
FIG. 1 illustrates a printing apparatus according to an embodiment.
Figure 2:
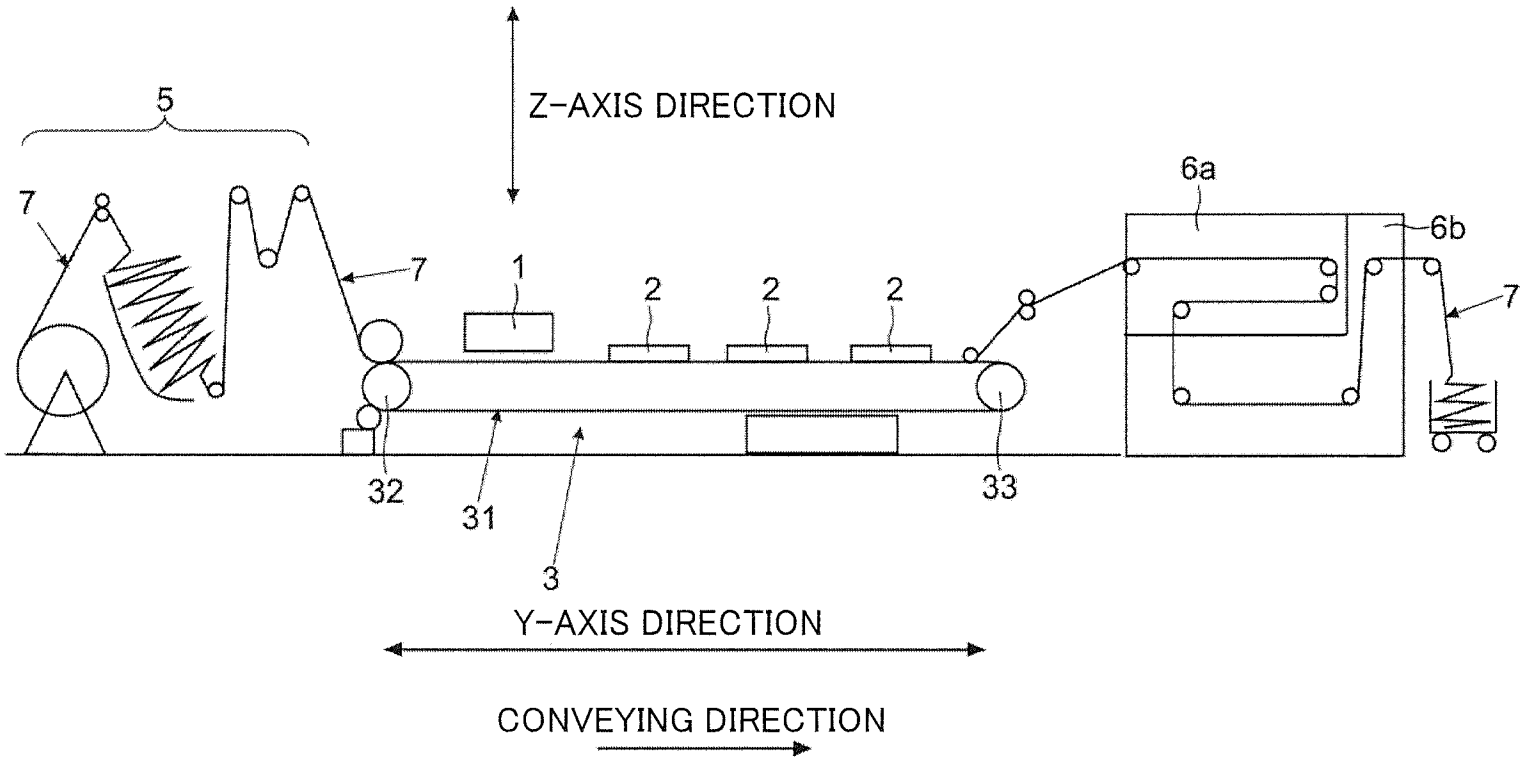
FIG. 2 illustrates the printing apparatus according to an embodiment.

First, an overall configuration of the printing apparatus 100 will be described with reference to FIGS. 1 to 3. The printing apparatus 100 includes an ink ejecting device 1 and a plate device 2. With this configuration, the printing apparatus 100 is able to perform both digital printing (inkjet printing) and analog printing (printing using a plate). That is, the printing apparatus 100 is a hybrid printing system. The printing apparatus 100 includes a conveying device 3 in addition to the ink ejecting device 1 and the plate device 2. The printing apparatus 100 further includes a control device 4, a fabric feeding device 5, a fixing device 6*a*, and a cleaning device 6*b*.

The conveying device 3 conveys the fabric 7. The plate device 2 is provided on a conveyance line of the fabric 7 conveyed by the conveying device 3. The ink ejecting device 1 is attachable to and detachable from the conveyance line of the fabric 7. For example, the ink ejecting device 1 is attachable to an existing conveyance line (a conveyance line in which the plate device 2 is already placed). Further, when a plurality of plate devices 2 are placed in an existing conveyance line, any one of the plate devices 2 may be detached and replaced by the ink ejecting device 1. Furthermore, the ink ejecting device 1 placed in an existing conveyance line may be detached. That is, the ink ejecting device 1 is attachable to and detachable from the printing apparatus 100 (the conveyance line of the fabric 7 of the conveying device 3). Therefore, the ink ejecting device 1 may be supplied to the market as a product on its own.

The ink ejecting device 1 may be fixed to the conveyance line of the fabric 7 of the conveying device 3. That is, the ink ejecting device 1 does not necessarily have to be detached from the conveyance line. In this case, the ink ejecting device 1, the plate device 2, and the conveying device 3 are sold in package.

The control device 4 controls the ink ejecting device 1, the plate device 2, the conveying device 3, the fabric feeding device 5, the fixing device 6*a*, and the cleaning device 6*b*. The fabric 7 rolled in a cylindrical form is set in the fabric feeding device 5. The fabric feeding device 5 feeds the fabric 7 to the conveying device 3. The fixing device 6*a* has the fabric 7 conveyed into it from the conveying device 3. The fixing device 6*a* fixes ink to the fabric 7. The cleaning device 6*b* has the fabric 7 conveyed into it from the fixing device 6*a*. The cleaning device 6*b* cleans the fabric 7.

The conveying device 3 includes a conveyor belt 31, a drive roller 32, a driven roller 33, and a conveyance motor 34. The conveying device 3 further includes a conveyance control unit 30. The conveyor belt 31 is wound around the drive roller 32 and the driven roller 33. The fabric 7 is stretched on the conveyor belt 31 (the fabric 7 is in contact with the conveyor belt 31). The conveyance motor 34 is a motor that makes the drive roller 32 turn. The conveyance control unit 30 is a circuit board including a control circuit (for example, a CPU).

The conveyance control unit 30 receives an instruction from the control device 4 and controls the conveyance motor 34. That is, the conveyance control unit 30 makes the drive roller 32 turn appropriately. As the drive roller 32 turns, the conveyor belt 31 turns around. As a result, the fabric 7 on the conveyor belt 31 is conveyed. Printing by the ink ejecting device 1 and printing by the plate device 2 are performed on the fabric 7 conveyed by the conveying device 3 (the fabric 7 on the conveyor belt 31).

The ink ejecting device 1 performs printing on the fabric 7 by ejecting ink onto the fabric 7. The ink ejecting device 1 is a kind of inkjet printer. That is, the ink ejecting device 1 includes a head 8 for ejecting ink (see FIG. 3).

Here, the ink ejecting device 1 achieves printing with a serial head system. However, the head 8 is movable not only in the X-axis direction but also in the Z-axis direction. With this configuration, the position of the head 8 in the Z-axis direction is adjustable, for example, before, after, and during printing.

A configuration of the ink ejecting device 1 will be described in detail later.

The plate device 2 performs printing on the fabric 7 using a plate. Printing by the plate device 2 is performed with the plate pressed against the fabric 7 from above (above in the Z-axis direction). That is, the fabric 7 conveyed by the conveying device 3 passes below the plate of the plate device 2 (below in the Z-axis direction).

In the printing by the plate device 2, a monochrome image can be printed by a single plate device 2. When a multi-colored image is printed, a number of plate devices 2 are incorporated in the printing apparatus 100. The number corresponds to the number of colors. That is, the number of placed plate devices 2 is not limited to one. For example, a plurality of plate devices 2 may be placed. Below, a configuration of one plate device 2 among a plurality of plate devices 2 will be described. Since those plate devices 2 are the same in configuration, no description of the configurations of the other plate devices 2 will be omitted.

The plate device 2 includes a frame 21, a screen plate 22 (corresponding to "plate"), a squeegee 23, a squeegee moving device 24, and a lifting device 25. The frame 21 holds the screen plate 22. The frame 21 is rectangular in outer shape. The screen plate 22 is disposed within the frame 21. Color paste (sizing agent) is placed on an upper surface of the screen plate 22. An ink transmitting portion that transmits ink (a portion through which ink is pushed out toward the fabric 7) is formed in the screen plate 22. The squeegee 23 is formed in a spatula shape. A lower end of the squeegee 23 is in contact with the upper surface of the screen plate 22. The squeegee moving device 24 includes a motor. The squeegee moving device 24 moves the squeegee 23 along the upper surface of the screen plate 22. The squeegee 23 and the squeegee moving device 24 are placed in the frame 21. The lifting device 25 lifts and lowers the frame 21.

The type of the plate device 2 is not particularly limited. For example, the plate device 2 may be a rotary screen fabric printer. Instead, the plate device 2 may be a roller fabric printer.

(Configuration of Ink Ejecting Device)

Figure 4:
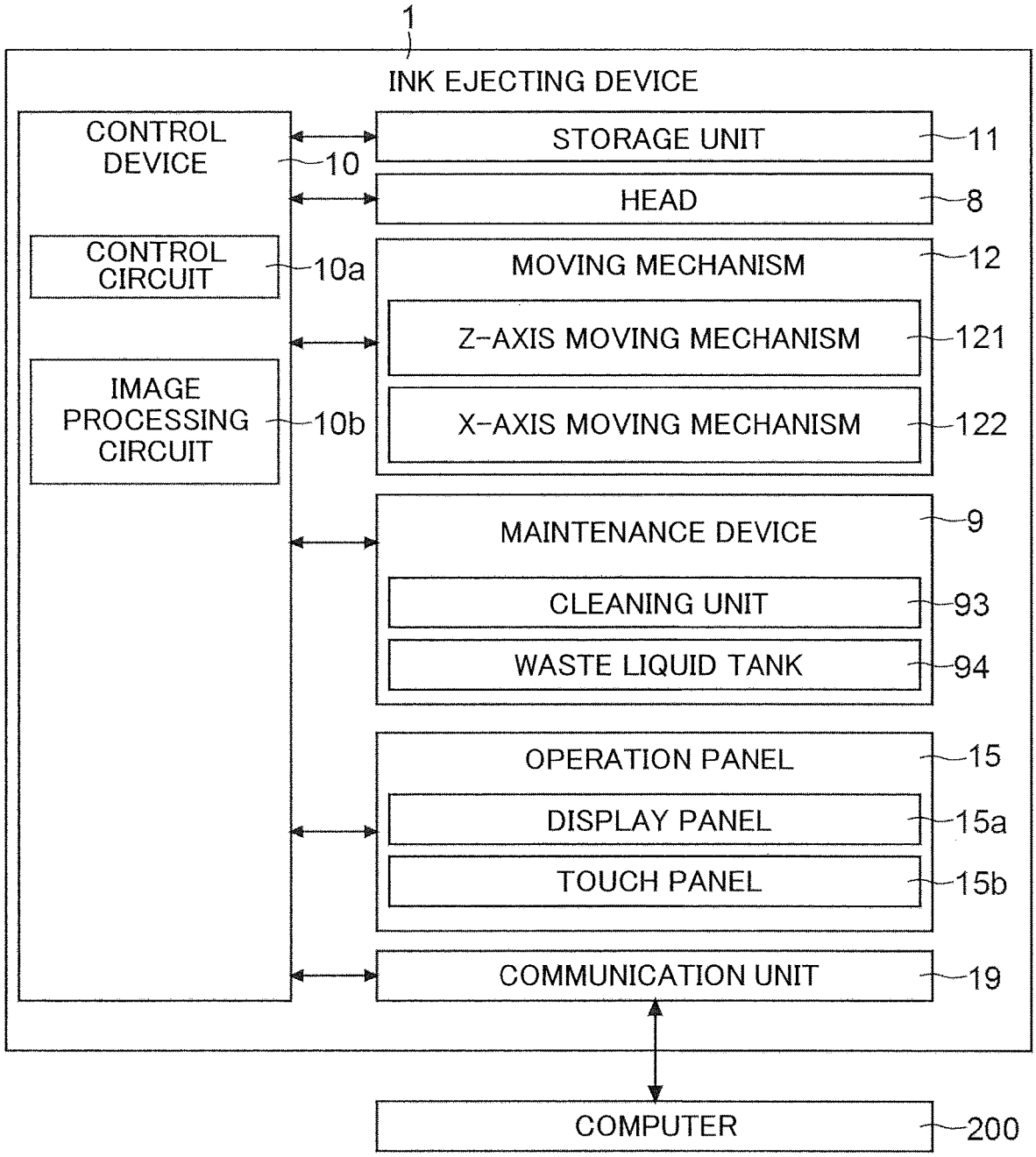
FIG. 4 illustrates an ink ejecting device according to an embodiment.

Next, a configuration of the ink ejecting device 1 will be described with reference to FIG. 4.

The ink ejecting device 1 includes a control unit 10 and a storage unit 11. The control unit 10 controls the ink ejecting device 1. The control unit 10 is a circuit board including a control circuit 10*a* (for example, a CPU) and an image processing circuit 10*b*. The control circuit 10*a* performs processes based on a control program and control data. The image processing circuit 10*b* performs image processing on image data D2 used for printing (details will be given later). The storage unit 11 includes a non-volatile storage device (for example, ROM, HDD, and flash ROM) and a volatile storage device (for example, RAM). The storage unit 11 stores a control program and control data.

Figure 5:
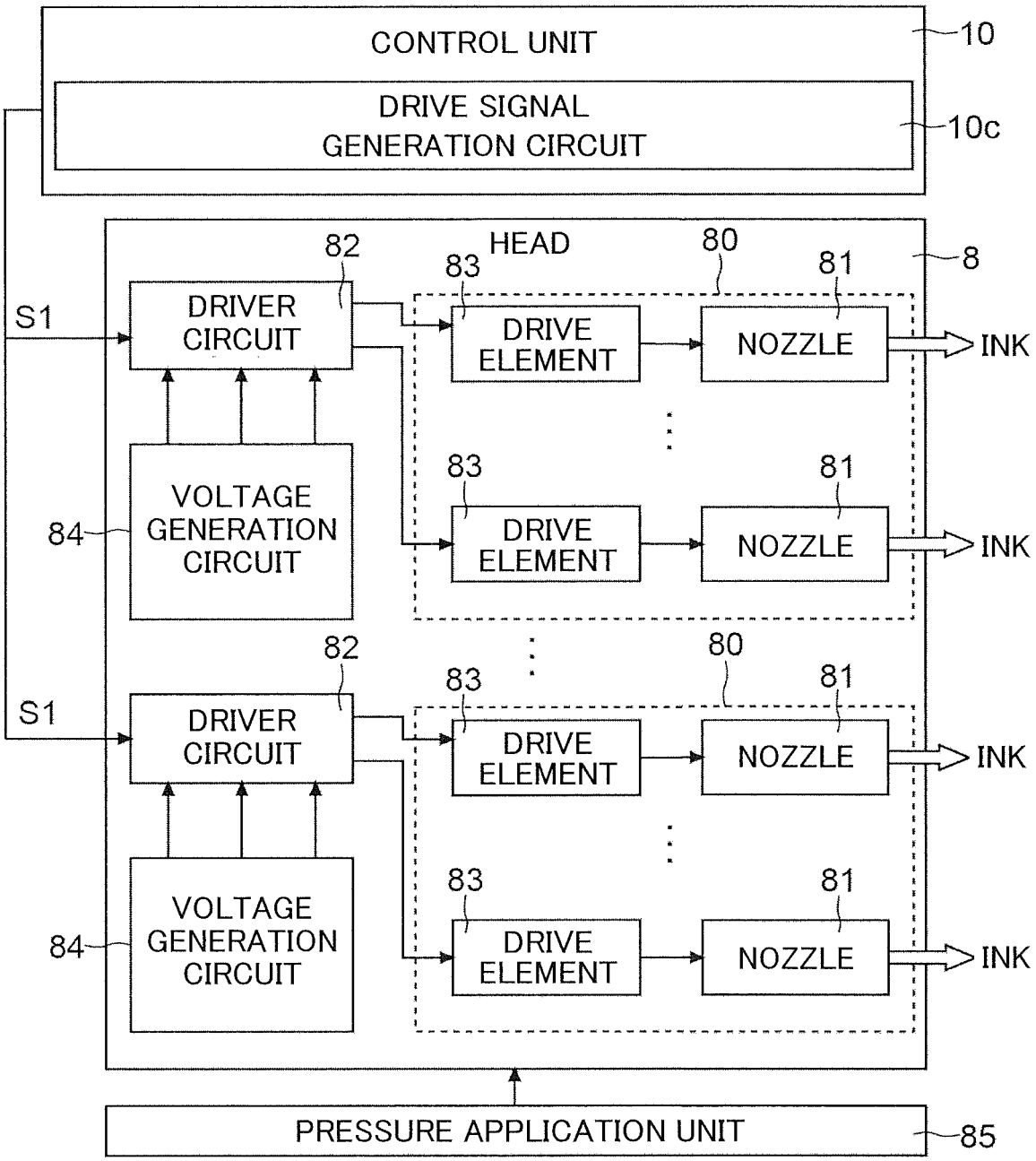
FIG. 5 illustrates a head of the ink ejecting device according to an embodiment.
Figure 6:
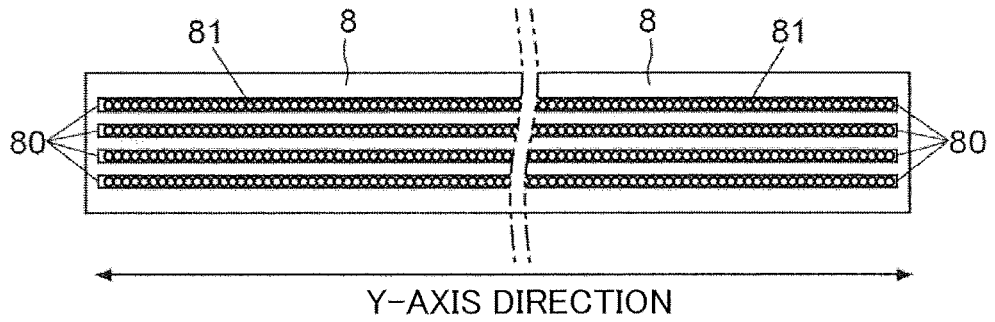
FIG. 6 illustrates the head of the ink ejecting device according to an embodiment.

The head 8 of the ink ejecting device 1 includes a plurality of nozzles 81 (see FIGS. 5 and 6). The head 8 ejects ink of a plurality of colors. For example, ink of black, yellow, cyan, and magenta is ejected from the head 8. In this manner, color printing is performed.

The control unit 10 makes the ink eject from the head 8 toward the fabric 7 during printing. The ink ejected from the head 8 adheres to a printing surface 71 of the fabric 7. In this manner, an image is printed on the printing surface 71.

The ink ejecting device 1 further includes a moving mechanism 12. The moving mechanism 12 is a mechanism for moving the head 8 in two axial directions. The moving mechanism 12 includes a Z-axis moving mechanism 121 and an X-axis moving mechanism 122. The Z-axis moving mechanism 121 is a mechanism for moving the head 8 in the Z-axis direction. The X-axis moving mechanism 122 is a mechanism for moving the head 8 in the X-axis direction.

The control unit 10 controls the moving mechanism 12 to move the head 8 appropriately. The control unit 10 controls the Z-axis moving mechanism 121 to adjust the position of the head 8 in the Z-axis direction (moves the head 8 in the Z-axis direction). Further, the control unit 10 controls the X-axis moving mechanism 122 to adjust the position of the head 8 in the X-axis direction (moves the head 8 in the X-axis direction).

The ink ejecting device 1 includes a maintenance device 9. The maintenance device 9 is a device for keeping the nozzles 81 (see FIGS. 5 and 6) in a normal condition. The maintenance device 9 is able to avoid clogging of the nozzles 81. Even if clogging of the nozzles 81 occur, the occurred clogging can be eliminated.

Figure 3:
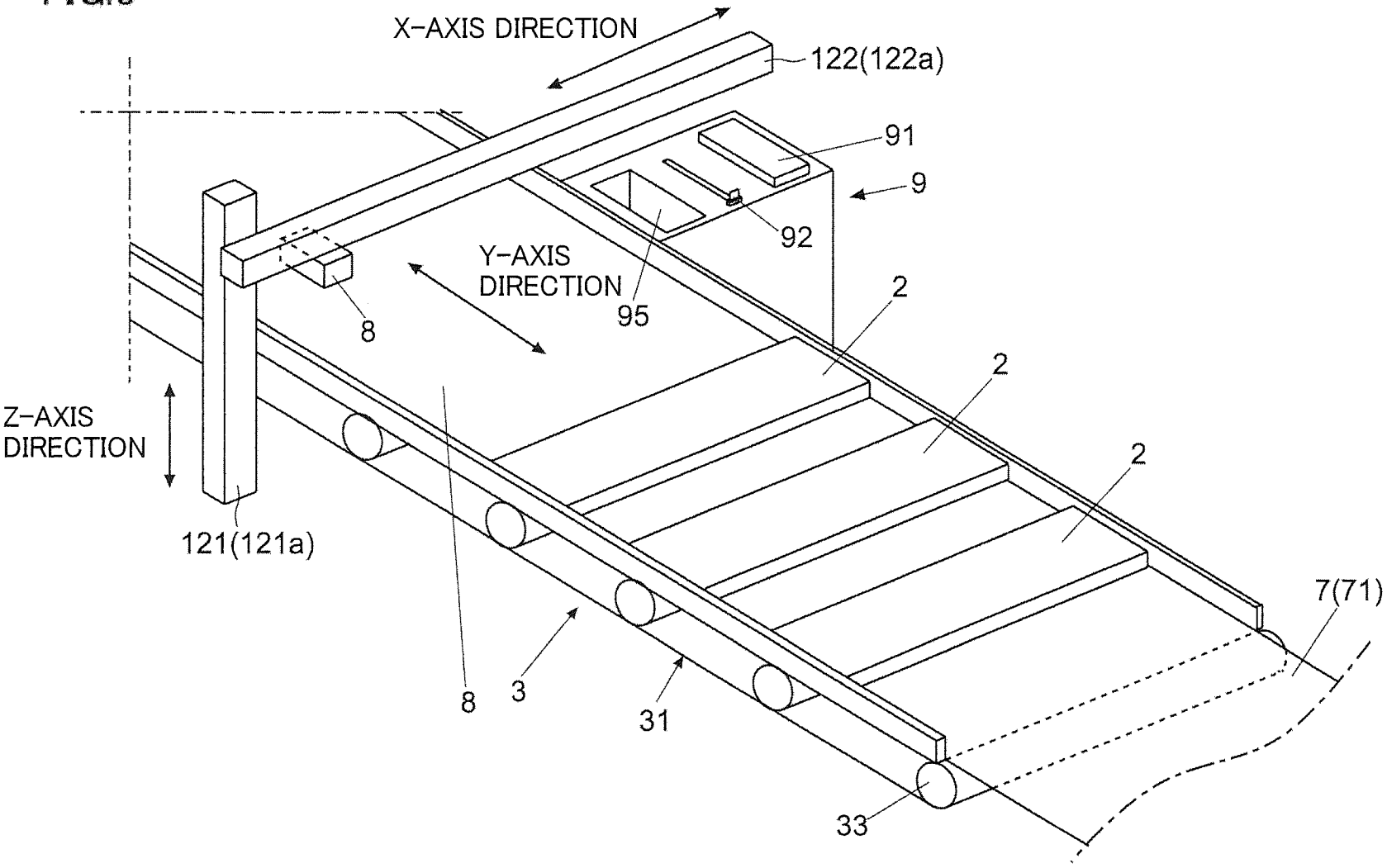
FIG. 3 illustrates the printing apparatus according to an embodiment.

The maintenance device 9 includes a cap 91 (see FIG. 3). The cap 91 is formed as a recess into which a nozzle surface (a lower surface) of the head 8 is fittable. The nozzle surface of the head 8 is a surface in which the nozzles 81 are formed. The cap 91 is, for example, a member formed by coating a piece of sheet metal with rubber. When the nozzle surface of the head 8 is fit into the cap 91, the nozzle surface of the head 8 is sealed.

The maintenance device 9 also includes a cleaning member 92 (see FIG. 3) and a cleaning unit 93. The cleaning member 92 is an elastically deformable plate-shaped member (i.e., a wiper). The cleaning member 92 is formed of, for example, a rubber material, such as EPDM. The cleaning member 92 is movable in the Y-axis direction. By moving the head 8 to an area in which the cleaning member 92 is placed, the nozzle surface of the head 8 can be brought into contact with the cleaning member 92. The cleaning unit 93 supplies (sprays) a cleaning liquid to the cleaning member 92.

The maintenance device 9 includes an opening 95 (see FIG. 3). An opening area of the opening 95 is larger than an area of the nozzle surface of the head 8. The opening 95 is connected to a waste liquid tank 94 through a flow path.

The ink ejecting device 1 includes an operation panel 15. The operation panel 15 includes a display panel 15*a* and a touch panel 15*b*.

The ink ejecting device 1 includes a communication unit 19. The communication unit 19 communicates with a computer 200. The computer 200 is, for example, a personal computer. The communication unit 19 receives print data D1 (details thereof will be given later) from the computer 200. The control unit 10 moves the head 8 based on the print data D1 and makes the head 8 eject ink.

(Configuration of Head)

Next, a configuration of the head 8 will be described with reference to FIGS. 5 and 6.

The head 8 includes a plurality of (four) nozzle arrays 80 each corresponding to one of the colors of black, yellow, cyan and magenta. In each nozzle array 80, a plurality of nozzles 81 are arranged in a row. Each nozzle array 80 has the same number of nozzles 81. The nozzle array 80 ejects ink of a corresponding color. The plurality of nozzles 81 of each nozzle array 80 are arranged in the Y-axis direction. The plurality of nozzles 81 of each nozzle array 80 are formed such that distances between the nozzles 81 adjacent in the Y-axis direction are equal.

The head 8 includes a drive element 83. One drive element 83 is provided for each nozzle 81. The drive element 83 is a piezoelectric element.

The head 8 also includes a driver circuit 82. One driver circuit 82 is provided for each nozzle array 80. The driver circuit 82 controls of application of a voltage to the drive element 83 (i.e., controls ejection of ink). The control unit 10 supplies the image data D2 (data indicating a nozzle 81 that is to eject ink) to the driver circuit 82 for each line. The driver circuit 82 applies a pulse voltage to the drive element 83 of the nozzles 81 that is to eject ink. The drive element 83 to which the voltage is applied is deformed. The pressure generated by the deformation of the drive element 83 is applied to a supply flow path (not illustrated) of the ink to the nozzles 81. In this manner, the ink is ejected from the nozzles 81 corresponding to the drive element 83 to which the voltage is applied. The driver circuit 82 does not apply a voltage to a drive element 83 corresponding to the nozzles 81 that are not to eject ink.

The head 8 also includes a voltage generation circuit 84. One voltage generation circuit 84 is provided for one driver circuit 82. The voltage generation circuit 84 generates a plurality of types of voltages. The driver circuit 82 applies the voltage generated by the voltage generation circuit 84 to the drive element 83. As the voltage applied to the drive element 83 increases, the deformation of the drive element 83 increases, and accordingly the amount of ink ejected increases. As the voltage applied to the drive element 83 decreases, the deformation of the drive element 83 decreases, and accordingly the amount of ink ejected decreases. In this manner, the ejection amount of ink can be adjusted.

The control unit 10 includes a drive signal generation circuit 10*c*. The drive signal generation circuit 10*c* generates a drive signal S1. The drive signal S1 is a signal for driving the head 8 (a driver circuit 82). The drive signal generation circuit 10*c* generates, for example, a clock signal. The head 8 (the driver circuit 82) ejects ink each time the drive signal S1 rises. A reference cycle of ink ejection is determined in advance. The control unit 10 causes the drive signal generation circuit 10*c* to generate the drive signal S1 so that the ink is ejected in the reference cycle.

(Configuration of Moving Mechanism)

Figure 7:
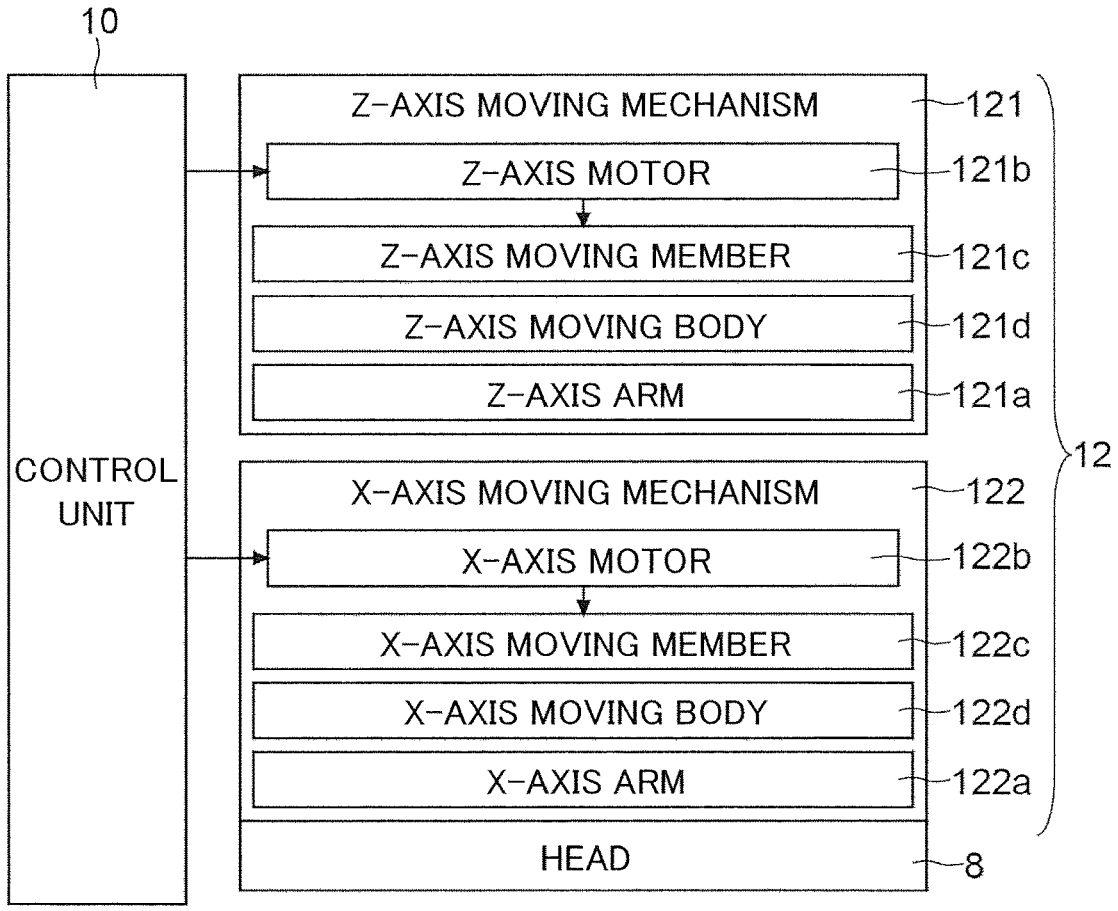
FIG. 7 illustrates a moving mechanism of the ink ejecting device according to an embodiment.

Next, a configuration of a moving mechanism 12 (the Z-axis moving mechanism 121 and the X-axis moving mechanism 122) will be described with reference to FIG. 7.

The Z-axis moving mechanism 121 includes a Z-axis arm 121*a*. The Z-axis arm 121*a* is a square column-shaped member. The Z-axis arm 121*a* incorporates a Z-axis motor 121*b*, a Z-axis moving member 121*c*, and a Z-axis moving body 121*d*. The Z-axis motor 121*b* is, for example, a stepping motor. The Z-axis motor 121*b* is turnable in the forward and reverse directions. The control unit 10 controls the Z-axis motor 121*b*. The Z-axis motor 121*b* makes the Z-axis moving member 121*c* turn. The Z-axis moving member 121*c* is, for example, a ball screw. The Z-axis moving body 121*d* is integrated with a nut attached to the ball screw. With this configuration, a turning movement of the Z-axis motor 121*b* is converted into a linear movement. As a result, the Z-axis moving body 121*d* moves in the Z-axis direction. The Z-axis arm 121*a* guides the movement of the Z-axis moving body 121*d* in the Z-axis direction.

The X-axis moving mechanism 122 includes an X-axis arm 122*a*. The X-axis arm 122*a* is a square column-shaped member. The X-axis arm 122*a* incorporates an X-axis motor 122*b*, an X-axis moving member 122*c*, and an X-axis moving body 122*d*. The X-axis motor 122*b* is, for example, a stepping motor. The X-axis motor 122*b* is turnable in the forward and reverse directions. The control unit 10 controls the X-axis motor 122*b*. The X-axis motor 122*b* makes the X-axis moving member 122*c* turn. The X-axis moving member 122*c* is, for example, a ball screw. The X-axis moving body 122*d* is integrated with a nut attached to the ball screw. With this configuration, a turning movement of the X-axis motor 122*b* is converted into a linear movement. As a result, the X-axis moving body 122*d* moves in the X-axis direction. The X-axis arm 122*a* guides the movement of the X-axis moving body 122*d* in the X-axis direction.

The Z-axis moving body 121*d* is connected to the X-axis moving mechanism 122. For example, the Z-axis moving body 121*d* is connected to an end of the X-axis arm 122*a*. With this configuration, the X-axis arm 122*a* moves in the Z-axis direction with the movement of the Z-axis moving body 121*d*. The control unit 10 controls the Z-axis motor 121*b* to change the position of the X-axis arm 122*a* in the Z-axis direction.

The head 8 is attached to the X-axis moving body 122*d* such that the row direction of each nozzle array 80 is parallel to the Y-axis direction. Specifically, the head 8 is held by a carriage 8*a* (see FIG. 8). The carriage 8*a* is attached to the X-axis moving body 122*d*. With this configuration, the head 8 moves in the X-axis direction with the movement of the X-axis moving body 122*d*.

The control unit 10 controls the Z-axis motor 121*b* to move the Z-axis moving body 121*d* in the Z-axis direction. As a result, the head 8 (X-axis arm 122*a*) moves in the Z-axis direction together with the Z-axis moving body 121*d*. Further, the control unit 10 controls the X-axis motor 122*b* to move the X-axis moving body 122*d* in the X-axis direction. As a result, the head 8 moves in the X-axis direction together with the X-axis moving body 122*d*.

During printing, the control unit 10 controls the X-axis motor 122*b* to perform scanning in which the head 8 is moved in the X-axis direction. Then, the control unit 10 causes the head 8 to eject ink during the scanning with the head 8.

Further, the control unit 10 controls the Z-axis motor 121*b* to adjust the position of the head 8 in the Z-axis direction. In this manner, a distance between the printing surface 71 of the fabric 7 and the nozzle surface of the head 8 can be changed.

The carriage 8*a* may be movable in the Z-axis direction relative to the X-axis arm 122*a*. Further, the head 8 may be movable in the Z-axis direction relative to the carriage 8*a*.

(Placement position of Maintenance Device)

Figure 8:
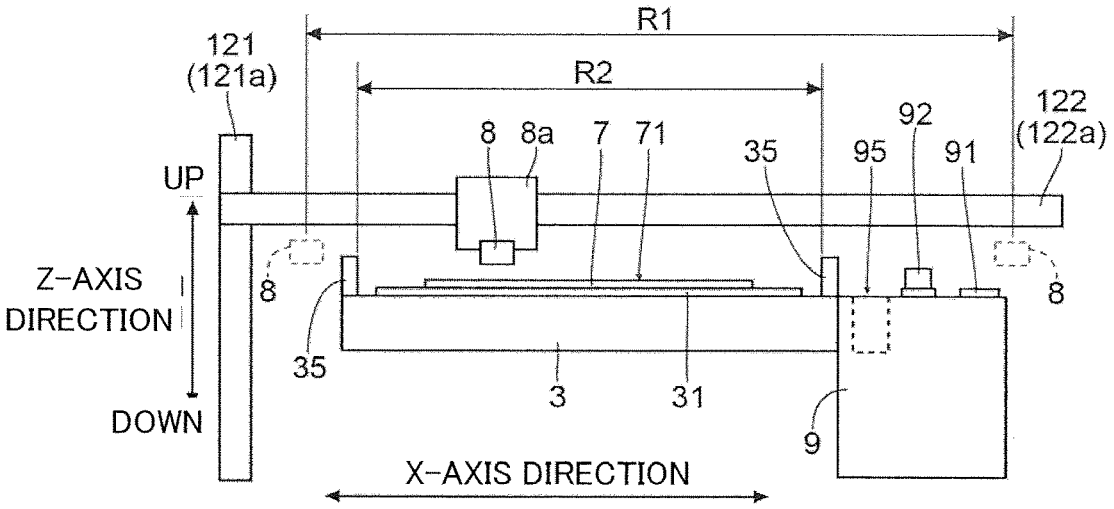
FIG. 8 illustrates a placement position in which a maintenance device provided in the ink ejecting device according to an embodiment is placed.

Next, a placement position of the maintenance device 9 will be described with reference to FIG. 8. FIG. 8 illustrates the fabric 7 conveyed by the conveying device 3.

Guides 35 (corresponding to "edge members") are provided at both ends of the conveying device 3 in the X-axis direction. The conveyor belt 31 is disposed between the pair of guides 35. That is, the fabric 7 conveyed by the conveying device 3 moves between the pair of guides 35. The pair of guides 35 is a member that prevents the fabric 7 from moving out of the conveying device 3.

A position of an upper surface (a surface in contact with the fabric 7) of the conveyor belt 31 in the Z-axis direction is lower than each end position of the pair of guides 35 in the Z-axis direction. Therefore, when printing is performed, the nozzle surface (the lower surface) of the head 8 is kept at a position lower than a position of an end of each of the guides 35 in the Z-axis direction. FIG. 8 illustrates the position of the nozzle surface of the head 8 in the Z-axis direction when printing is performed.

The maintenance device 9 is placed at a position within a movable range R1 of the head 8 in the X-axis direction and outside an inter-guide range R2, which is between both ends (a pair of guides 35) of the conveying device 3 in the X-axis direction. Further, the maintenance device 9 is placed at a position lower than each end position of the pair of guides 35 in the Z-axis direction.

(Print Data Including Image Data)

Figure 9:
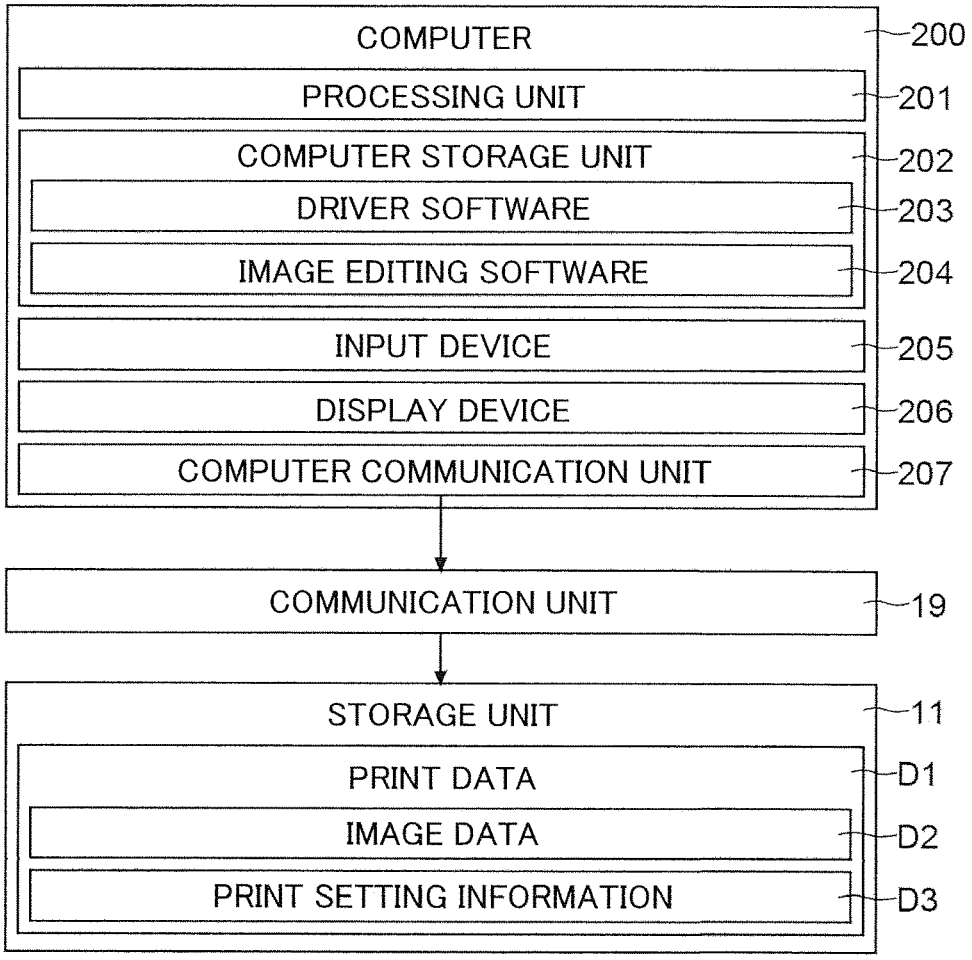
FIG. 9 is a diagram explaining print data input to the ink ejecting device according to an embodiment.

Next, the print data D1 including the image data D2 will be described with reference to FIG. 9.

The computer 200 transmits the print data D1 to the ink ejecting device 1. The computer 200 may be considered as a part of the printing apparatus 100. The computer 200 includes a processing unit 201, a computer storage unit 202, an input device 205, a display device 206, and a computer communication unit 207. The processing unit 201 is a circuit board including a processing circuit (for example, a CPU). The computer storage unit 202 includes ROM, RAM, and HDD. The computer storage unit 202 stores driver software 203 for generating print data D1. The computer storage unit 202 stores image editing software 204 for editing the image data D2 used for printing. The input device 205 is an input device, such as a hardware keyboard and a pointing device. A user uses the input device 205 to edit the image data D2. The user also uses the input device 205 to input a print command. The display device 206 is a display. The computer communication unit 207 is a communication interface.

When a print command is input, the processing unit 201 starts the driver software 203. Based on the driver software 203, the processing unit 201 causes the display device 206 to display a setting screen for receiving print settings from the user. The input device 205 receives print settings from the user. For example, the input device 205 receives setting of a printing position of an image in a unit print range E1 (details will be given later), and receives setting of a printing resolution.

The processing unit 201 generates print data D1 based on the driver software 203. The print data D1 includes the image data D2 and print setting information D3. The processing unit 201 generates the image data D2 of a resolution set by the user (user-specified resolution). The processing unit 201 includes the setting content of the print setting set by the user in the print setting information D3. For example, the processing unit 201 includes the print position and the print resolution in the print setting information D3. When printing a plurality of types of images in one unit print range E1, the processing unit 201 includes a plurality of pieces of image data D2 respectively corresponding to a plurality of types of images in the print data D1, and includes setting contents of a plurality of print settings respectively corresponding to a plurality of types of images in the print data D1.

Then, the processing unit 201 transmits the print data D1 to the ink ejecting device 1 by using the computer communication unit 207 (i.e., the print data D1 is input to the ink ejecting device 1). The storage unit 11 of the ink ejecting device 1 stores the print data D1. Instead, only the image data D2 may be input to the ink ejecting device 1. In this case, the operation panel 15 of the ink ejecting device 1 receives print settings from the user. Then, the control unit 10 of the ink ejecting device 1 generates the print data D1.

(Conveyance of Fabric and Printing on Fabric)

Figure 10:
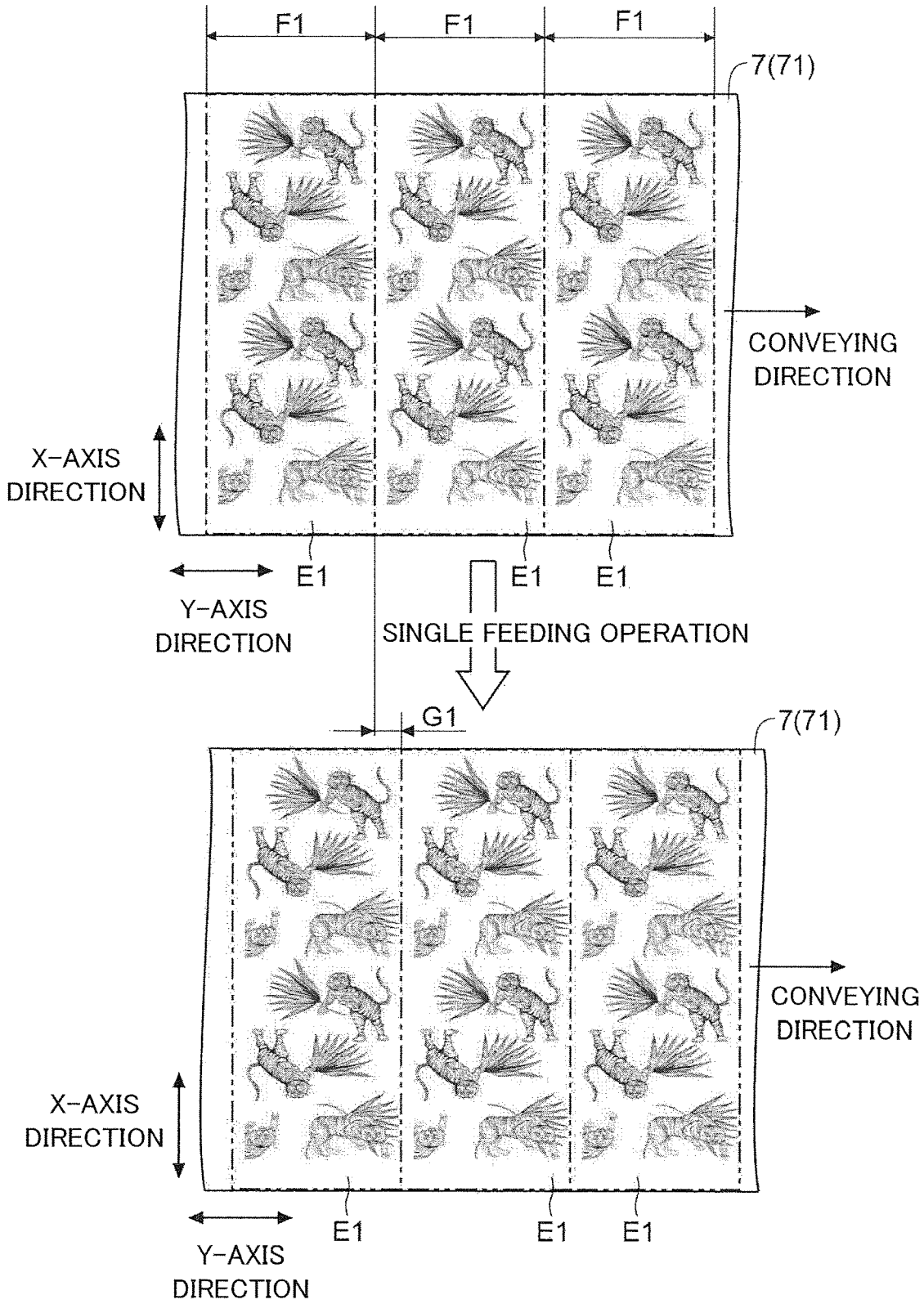
FIG. 10 is a diagram explaining a feeding amount of fabric conveyed by the printing apparatus according to an embodiment.

Next, conveyance of the fabric 7 and printing on the fabric 7 will be described with reference to FIG. 10.

The conveying device 3 conveys the fabric 7 in the Y-axis direction by performing an operation in which it repeats a feeding operation, which is an operation of feeding the fabric 7 in the Y-axis direction (the conveyance direction) by a predetermined amount, and a stop of the feeding operation. That is, the conveying device 3 conveys the fabric 7 in the Y-axis direction by a constant amount at a time. In the following description, an operation of repeating the feeding operation and the stop of the feeding operation (an operation performed when the conveying device 3 conveys the fabric 7) is referred to as a conveying operation, so as to be distinguished from the feeding operation.

In printing by the printing apparatus 100 (the ink ejecting device 1 and the plurality of plate devices 2), the fabric 7 to print on is sectioned into a plurality of unit print ranges E1. In FIG. 10, the unit print ranges E1 are surrounded by two-dot chain lines. The length of the unit print range E1 in the Y-axis direction is the same as the length of the screen plate 22 of the plate device 2 in the Y-axis direction. In the description below, the length of the unit print range E1 in the Y-axis direction is referred to as a prescribed length F1. The length of the unit print range E1 in the X-axis direction is the same as the length of the fabric 7 in the X-axis direction. When a plurality of plate devices 2 are placed in the printing apparatus 100, a distance in the Y-axis direction between the screen plates 22 of the plate devices 2 adjacent to each other in the Y-axis direction is set to the prescribed length F1.

The conveying device 3 feeds the fabric 7 in the Y-axis direction by an amount corresponding to a predetermined length G1 at a time when printing is performed (the conveying device 3 repeats the feeding operation and the stop of the feeding operation). When the conveying device 3 performs the feeding operation once, the state illustrated in the upper view of FIG. 10 changes to the state illustrated in the lower view of FIG. 10.

For example, the control unit 10 of the ink ejecting device 1 sets the predetermined length G1 (a feeding amount in a single feeding operation by the conveying device 3). When setting the predetermined length G1, the control unit 10 recognizes the user-specified resolution included in the print setting information D3 in the print data D1 received from the computer 200. Then, the control unit 10 sets the predetermined length G1 based on the resolution specified by the user.

The control unit 10 transmits information indicating the predetermined length G1 corresponding to the resolution specified by the user to the control device 4 as conveyance control information. The control device 4 transmits the conveyance control information to the conveying device 3. The conveyance control unit 30 of the conveying device 3 recognizes the predetermined length G1 indicated by the conveyance control information. The conveyance control unit 30 sets an amount corresponding to the recognized predetermined length G1 as a feeding amount of the feeding operation performed during printing. Then, when printing is performed, the conveying device 3 feeds the fabric 7 by a feeding amount in accordance with the resolution specified by the user (the feeding amount in one feeding operation by the conveying device 3 is an amount in accordance with the resolution specified by the user). That is, the conveying device 3 changes the feeding amount by which to feed the fabric in one feeding operation in accordance with a printing resolution by the ink ejecting device 1.

The ink ejecting device 1 performs printing on the fabric 7 while the conveying operation by the conveying device 3 (i.e., the operation of repeating the feeding operation and the stop of the feeding operation) is performed. A print range for one printing event on the ink ejecting device 1 is the unit print range E1. A print range for one printing event on the ink ejecting device 1 is the same as a print range for one printing event at each screen plate 22 of the plurality of plate devices 2.

The ink ejecting device 1 prints an image on an area in the unit print range E1 in which no printing is performed by the plate device 2. For example, among images to be printed on the fabric 7, multi-colored images and gradation images are printed by the ink ejecting device 1. Although the fabric 7 is sectioned into a plurality of unit print ranges E1, the same images are printed in a plurality of unit print ranges E1.

When the feeding operation by the conveying device 3 is being suspended, the control unit 10 of the ink ejecting device 1 controls the X-axis moving mechanism 122 to perform scanning in which the head 8 is moved in the X-axis direction. During the scanning with the head 8, the control unit 10 causes the head 8 to eject ink based on the print data D1 (image data D2 included in the print data D1). After one scanning event ends (i.e., after moving the head 8 from a scan start position to a scan end position), the control unit 10 controls the X-axis moving mechanism 122 to return the head 8 from the scan end position to the scan start position.

When one scanning event ends, the conveyance control unit 30 of the conveying device 3 performs a feeding operation of feeding the fabric 7 in the Y-axis direction and stops the feeding operation. At this time, the fabric 7 is fed by an amount corresponding to the predetermined length G1. When the fabric 7 is fed in the Y-axis direction by an amount corresponding to the predetermined length G1 after one scanning event ends, the control unit 10 of the ink ejecting device 1 performs scanning with the head 8 (ejection of ink) again and then returns the head 8 from the scan end position to the scan end position.

As described above, the ink ejecting device 1 performs scanning with the head 8 once each time the conveying device 3 performs the feeding operation once. The conveying device 3 performs the feeding operation of feeding the fabric 7 once by an amount corresponding to the predetermined length G1 each time one scanning event ends. That is, after one scanning event ends, the fabric 7 is fed by an amount in accordance with the printing resolution of the ink ejecting device 1 (the resolution specified by the user) (i.e., an amount corresponding to the predetermined length G1).

Each of the plurality of plate devices 2 performs printing on the fabric 7 when the conveying operation by the conveying device 3 (the operation of repeating the feeding operation and the stop of the feeding operation) is temporarily suspended. A print range for one printing event at each screen plate 22 of the plurality of plate devices 2 (hereinafter referred to as screen print range) is the unit print range E1. A print range for one printing event at each screen plate 22 of the plurality of plate devices 2 is the same as a print range for one printing event on the ink ejecting device 1.

Each of the plurality of plate devices 2 prints an image on an area in the unit print range E1 in which no printing is performed by the ink ejecting device 1. For example, among images to be printed on the fabric 7, solid images are printed by the plurality of plate devices 2. Each of the plurality of plate devices 2 prints an image of the corresponding color in the unit print range E1. A printing process in a certain plate device 2 among the plurality of plate devices 2 will be described below. Printing is performed in the same manner in other plate devices 2.

When a unit print range E1 on the fabric 7 enters the screen print range of the plate device 2, the conveyance control unit 30 of the conveying device 3 temporarily suspends the conveying operation. The temporary suspension of the conveying operation by the conveying device 3 is continued until the printing on the unit print range E1 on the fabric 7 by the plate device 2 ends. Note that the fact that a certain unit print range E1 on the fabric 7 is included in the screen print range of a certain plate device 2 means that another unit print range E1 on the fabric 7 is included in the screen print range of another plate device 2.

When the conveying operation by the conveying device 3 is temporarily suspended, the ink ejecting device 1 performs one scanning event with the head 8. Even after the scanning ends, the plate device 2 is made to print on the fabric 7.

Accordingly, the conveying device 3 does not perform the feeding operation. That is, temporary suspension of the conveying operation by the conveying device 3 is continued. Thus, the ink ejecting device 1 is in a standby state.

When the conveying operation by the conveying device 3 is temporarily suspended, the control device 4 causes the plate device 2 to print. At this time, the control device 4 controls the lifting device 25 to move the frame 21 in the direction toward the fabric 7 (downward in the Z-axis direction) until the lower surface of the screen plate 22 contacts the fabric 7. Thereafter, the control device 4 controls the squeegee moving device 24 to cause the squeegee 23 to reciprocate in the X-axis direction within the frame of the frame 21.

The squeegee 23 reciprocates in the X-axis direction while in contact with the upper surface of the screen plate 22. That is, the squeegee 23 rubs against the upper surface of the screen plate 22. Since color paste is placed on the upper surface of the screen plate 22, the color paste is pushed out through the ink transmitting portion of the screen plate 22 toward the fabric 7. In this manner, the image is printed on the fabric 7.

Thereafter, the control device 4 controls the lifting device 25 to move the frame 21 in a direction away from the fabric 7 (upward in the Z-axis direction). In this manner, the lower surface of the screen plate 22 and the fabric 7 are separated. In the printing in the unit print range E1 on the fabric 7 by the plate device 2, the process so far is performed as one set.

After the printing in the unit print range E1 on the fabric 7 by the plate device 2 ends, the conveying device 3 resumes the conveying operation, and conveys the fabric 7 in the Y-axis direction (the conveyance direction). That is, the conveying device 3 repeats the feeding operation and the stop of the feeding operation. When the fabric 7 is fed by an amount corresponding to the predetermined length G1, the ink ejecting device 1 performs scanning with the head 8. The control device 4 causes the plate device 2 to stand by until the next unit print range E1 enters the screen print range of the plate device 2.

The conveying device 3 temporarily suspends the conveying operation each time the unit print range E1 enters the screen print range of the plate device 2. That is, the conveying device 3 repeats the conveying operation and the temporary suspension of the conveying operation. The control device 4 causes the plate device 2 to print each time the conveying operation by the conveying device 3 is temporarily suspended (each time the unit print range E1 enters the screen print range of the plate device 2).

(Capping Process)

Next, a capping process will be described with reference to FIGS. 11 and 12.

If the nozzles 81 are left exposed, the ink in the nozzles 81 dries and viscosity of the ink in the nozzles 81 increases. When the ink in the nozzles 81 dries further, the ink in the nozzles 81 solidifies. Then, the nozzles 81 tend to easily clog with the ink. When the nozzles 81 are clogged, ink is not ejected from the nozzles 81 even if a voltage is applied to the drive element 83. This leads to a problem of reduced image quality.

In order to avoid such a problem, the control unit 10 performs a capping process. Through the capping process, a nozzle surface of the head 8 is fit into the cap 91. In this manner, clogging of the nozzles 81 can be avoided. The capping process is one of conditioning processes that keeps the nozzles 81 in a normal condition.

Figure 11:
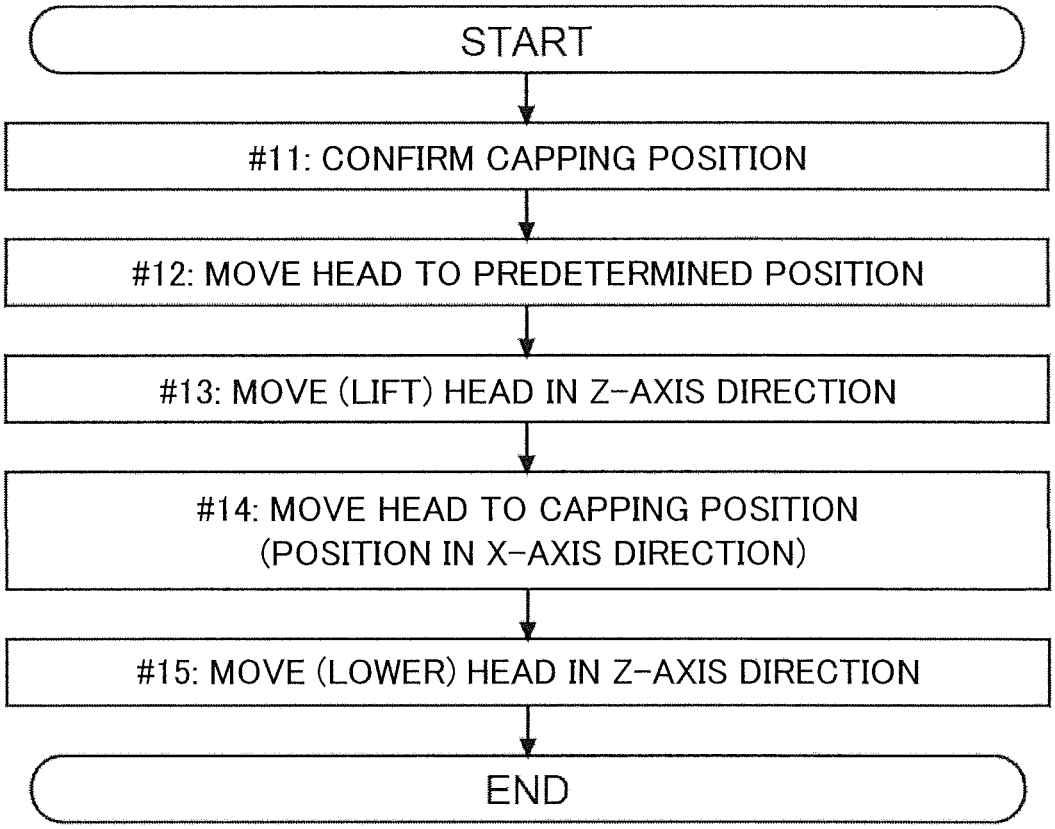
FIG. 11 is a diagram explaining a capping process performed by the ink ejecting device according to an embodiment.
Figure 12:
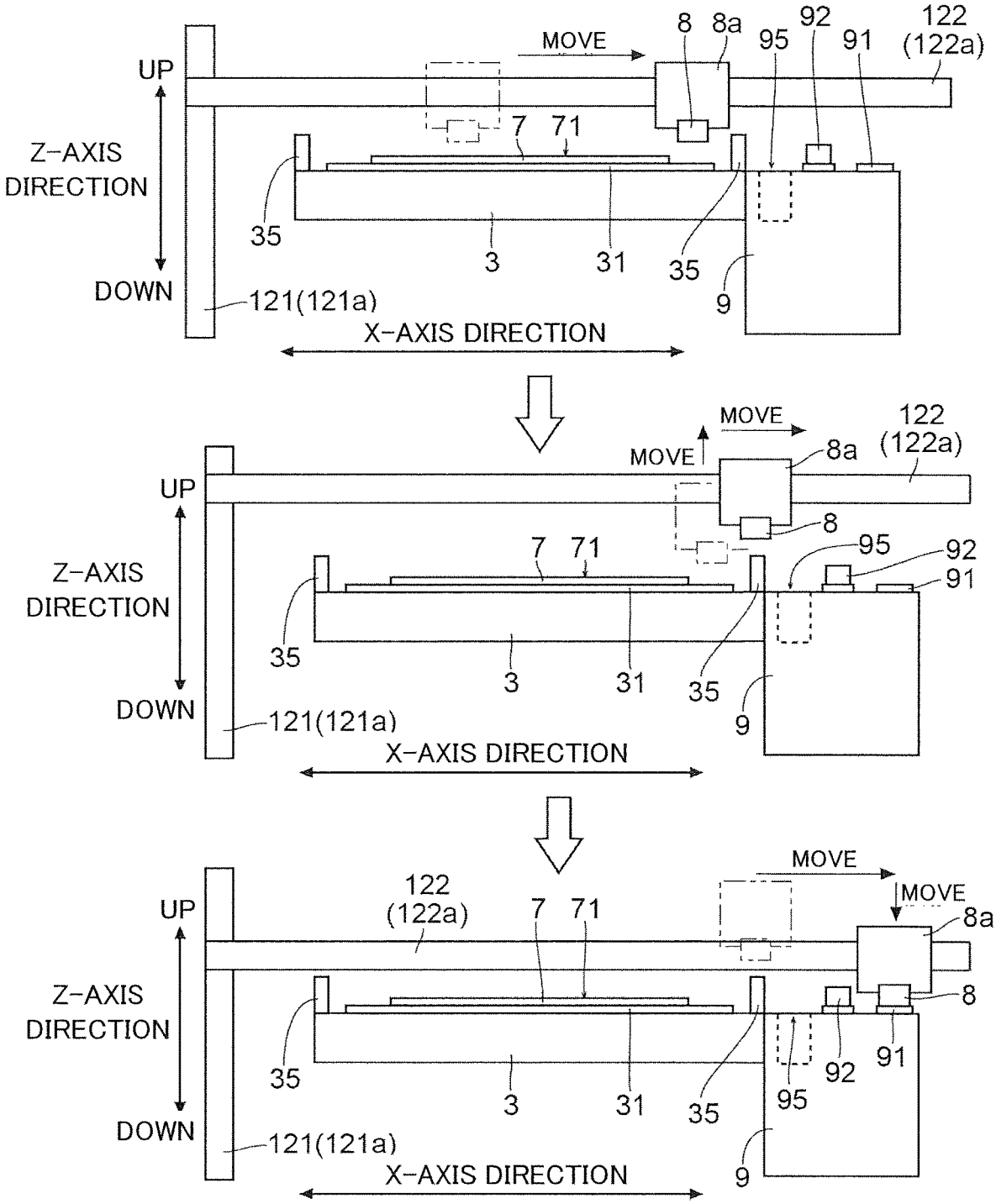
FIG. 12 is a diagram explaining a movement path of a head of the ink ejecting device according to an embodiment.

The control unit 10 performs the process according to the flowchart in FIG. 11 to fit the nozzle surface of the head 8 into the cap 91. The process shown in the flowchart in FIG. 11 starts when the control unit 10 determines that a predetermined capping condition is satisfied.

For example, when the operation panel 15 receives a capping instruction from the user, the control unit 10 determines that the capping condition is satisfied. When, for example, the conveyance line in the printing apparatus 100 breaks down, and printing is no longer able to be performed for a long time, the user issues a capping instruction via the operation panel 15.

Further, when the capping time set by the user comes, the control unit 10 determines that the capping condition is satisfied. The capping time can be set arbitrarily by the user. The operation panel 15 receives the setting of the capping time from the user. The start time and the end time of a lunch break may be set as the capping time. The capping time is stored in the storage unit 11.

Further, when all the printing on one roll of the fabric 7 ends, the control unit 10 may determine that the capping condition is satisfied. Even before all the printing on one roll of the fabric 7 ends, if printing to be performed by the ink ejecting device 1 has ended, the control unit 10 may determine that the capping condition is satisfied.

Before the capping process, a flushing process, which will be described later, may be performed. Further, before the capping process, a wiping process, which will be described later, may be performed. Both the flushing process and the wiping process may be performed before the capping process. In this case, when the capping condition is satisfied, the control unit 10 performs the capping process after performing at least one of the flushing process and the wiping process.

In any case, the control unit 10 performs the capping process when no printing by the head 8 is performed. For example, there is a case in which only printing by the plate device 2 is performed and no printing by the ink ejecting device 1 is performed. The capping process may be performed in this case.

If it is determined that the capping condition is satisfied, the control unit 10 first confirms a capping position (step #11). The capping position is stored in the storage unit 11. The capping position is a position in which the cap 91 is placed, and a position in which the nozzle surface of the head 8 is able to be fit into the cap 91. The storage unit 11 stores the position (coordinate) of the cap 91 in the X-axis direction and the position (coordinate) of the cap 91 in the Z-axis direction as the capping position.

Next, the control unit 10 controls the X-axis moving mechanism 122 to move the head 8 in the X-axis direction until the head 8 reaches a predetermined position (step #12). The predetermined position is set within the inter-guide range R2 (see FIG. 8) in the movable range R1 of the head 8 (see FIG. 8), near that a guide 35 which is located closer to the area in which the maintenance device 9 is placed. The predetermined position is stored in the storage unit 11. The storage unit 11 stores the coordinate of the predetermined position in the X-axis direction. The head 8 moved to the predetermined position is illustrated in the upper part of FIG. 12.

Next, the control unit 10 controls the Z-axis moving mechanism 121 to adjust the position of the nozzle surface of the head 8 in the Z-axis direction to a position higher than the end position of the guide 35 in the Z-axis direction (step #13). That is, the control unit 10 lifts the head 8.

Next, the control unit 10 controls the X-axis moving mechanism 122 to move the head 8 in the X-axis direction until the head 8 reaches the position of the capping position in the X-axis direction (step #14). That is, the control unit 10 moves the head 8 toward a placement area of the maintenance device 9 (i.e., the capping position). As a result, the head 8 is placed at the position of the capping position in the X-axis direction.

Here, the head 8 moving in the X-axis direction toward the capping position crosses the guide 35. At this time, the position of the nozzle surface of the head 8 in the Z-axis direction is higher than the end position of the guide 35 in the Z-axis direction. Therefore, the head 8 and the guide 35 do not contact each other. That is, the head 8 moving in the X-axis direction toward the capping position moves over the guide 35. The state when the head 8 rides over the guide 35 is illustrated in the middle diagram of FIG. 12.

Next, the control unit 10 controls the Z-axis moving mechanism 121 to adjust the position of the nozzle surface of the head 8 in the Z-axis direction to a position lower than the end position of the guide 35 in the Z-axis direction (step #15). That is, the control unit 10 lowers the head 8.

At this time, the control unit 10 moves (lowers) the head 8 in the Z-axis direction until the nozzle surface of the head 8 reaches the position of the capping position in the Z-axis direction. Thus, the nozzle surface of the head 8 is fit into the cap 91. A state in which the nozzle surface of the head 8 is fit into the cap 91 is illustrated in the lower diagram of FIG. 12.

When printing is performed after the nozzle surface of the head 8 is fit into the cap 91, the control unit 10 moves (lifts) the head 8 in the Z-axis direction. Thereafter, the control unit 10 moves the head 8 in the X-axis direction to place the head 8 within the inter-guide range R2 (see FIG. 8). Then, the control unit 10 moves (lowers) the head 8 in the Z-axis direction until the position of the nozzle surface of the head 8 in the Z-axis direction reaches a printable position (a position in which printing on the fabric 7 is possible).

(Flushing Process)

Next, the flushing process will be described with reference to FIGS. 13 and 14.

Viscosity of the ink in the nozzles 81 with a smaller number of times of ink ejection increases with time. This causes clogging of the nozzles 81. This leads to a problem of reduced image quality.

In order to avoid such a problem, the control unit 10 performs a flushing process. In the flushing process, the ink accumulated in the nozzles 81 is ejected (the ink is ejected from the head 8 as well as in normal printing). The control unit 10 takes all the nozzles 81 as processing targets of the flushing process (i.e., ink is ejected from all the nozzles 81). In this manner, clogging of the nozzles 81 can be avoided. The flushing process is one of conditioning processes that keeps the nozzles 81 in a normal condition.

Figure 13:
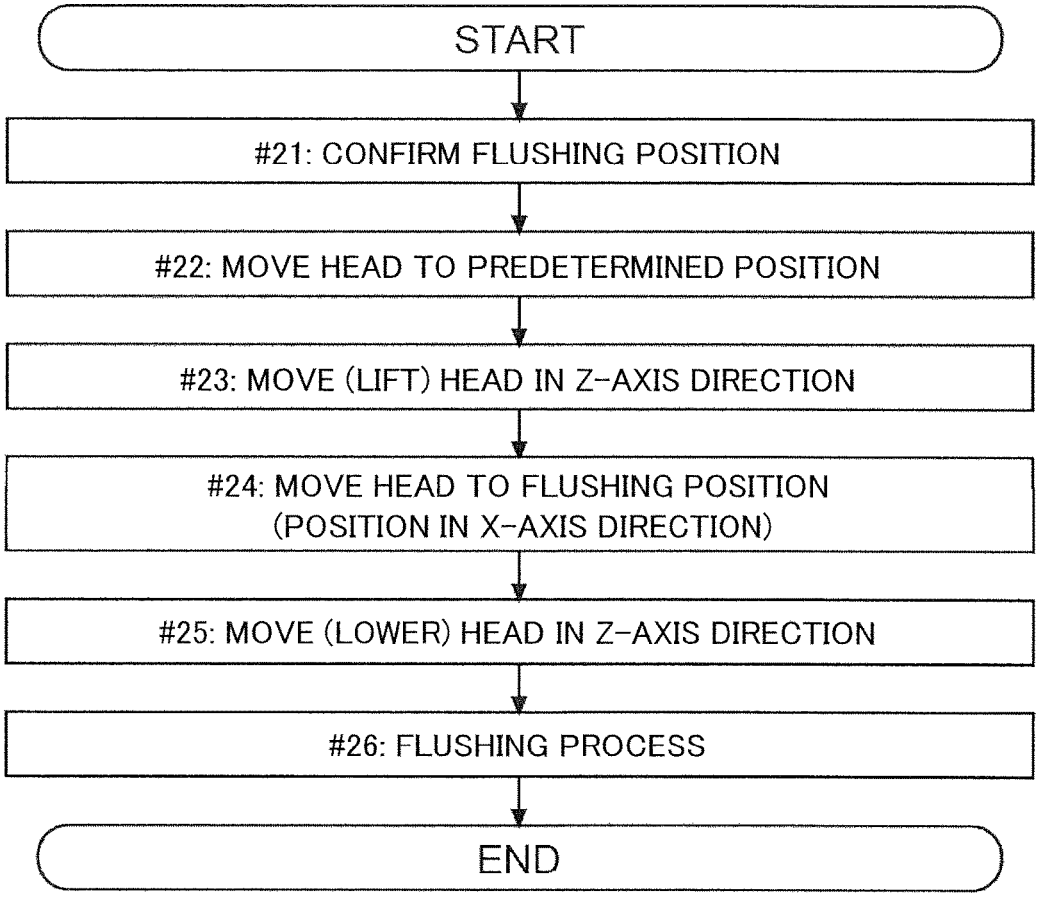
FIG. 13 is a diagram explaining a flushing process performed by the ink ejecting device according to an embodiment.

The control unit 10 ejects the ink accumulated in the nozzles 81 by performing the process according to the flowchart in FIG. 13. The flowchart in FIG. 13 starts when the control unit 10 determines that the predetermined flushing condition is satisfied.

When the conveying device 3 temporarily suspends the conveying operation (the operation of repeating the feeding operation and the stop of the feeding operation) to cause the plate device 2 to print on the fabric 7, the control unit 10 determines that the flushing condition is satisfied and perform the flushing process. The control unit 10 determines that the flushing condition is satisfied each time the conveying device 3 temporarily suspends the conveying operation. That is, the control unit 10 performs the flushing process each time the conveying device 3 temporarily suspends the conveying operation (the i.e., the flowchart in FIG. 13 starts).

The control unit 10 performs scanning with the head 8 when the conveying device 3 temporarily suspends the conveying operation. After one scanning event ends (after the head 8 is moved from the scan start position to the scan end position), the control unit 10 subsequently performs the flushing process.

When the operation panel 15 receives a flushing instruction from the user, the control unit 10 may determine that the flushing condition is satisfied. Further, when all the printing on one roll of the fabric 7 ends, the control unit 10 may determine that the flushing condition is satisfied. When all the printing to be performed by the ink ejecting device 1 ends, even before all the printing on one roll of the fabric 7 ends, the control unit 10 may determine that the flushing condition is satisfied.

Further, the control unit 10 may determine that the flushing condition is satisfied when the capping condition is satisfied. That is, the capping condition and the flushing condition may be the same. In this case, the capping process is performed after the flushing process is performed.

If it is determined that the capping condition is satisfied, the control unit 10 first confirms a flushing position (step #21). The flushing position is stored in the storage unit 11. The flushing position is a position in which all the nozzles 81 face the opening 95. That is, the flushing position is set above the opening 95 (upward in the Z-axis direction). The storage unit 11 stores the position (coordinate) in the X-axis direction of the flushing position and the position (coordinate) in the Z-axis direction of the flushing position.

Next, the control unit 10 controls the X-axis moving mechanism 122 to move the head 8 in the X-axis direction until the head 8 reaches a predetermined position (step #22). The process of step #22 is the same as the process of step #12 illustrated in FIG. 11. That is, when the head 8 is moved to the predetermined position, the state illustrated in the upper diagram of FIG. 12 is obtained.

Next, the control unit 10 controls the Z-axis moving mechanism 121 to adjust the position of the nozzle surface of the head 8 in the Z-axis direction to a position higher than the end position of the guide 35 in the Z-axis direction (step #23). That is, the control unit 10 lifts the head 8.

Next, the control unit 10 controls the X-axis moving mechanism 122 to move the head 8 in the X-axis direction until the head 8 reaches the position of the flushing position in the X-axis direction (step #24). That is, the control unit 10 moves the head 8 toward a placement area of the maintenance device 9 (i.e., the flushing position). As a result, the head 8 is placed in the X-axis direction of the flushing position. That is, all the nozzles 81 face the opening 95.

When the head 8 crosses the guide 35, the head 8 moves over the guide 35. That is, as when the head 8 is moved to the capping position, the head 8 and the guide 35 do not contact each other (see the middle diagram of FIG. 12).

Next, the control unit 10 controls the Z-axis moving mechanism 121 to adjust the position of the nozzle surface of the head 8 in the Z-axis direction to a position lower than the end position of the guide 35 in the Z-axis direction (step #25). That is, the control unit 10 lowers the head 8.

At this time, the control unit 10 moves (lowers) the head 8 in the Z-axis direction until the nozzle surface of the head 8 reaches the position of the flushing position in the Z-axis direction. A state in which the nozzle surface of the head 8 is at a position of the flushing position in the Z-axis direction is illustrated in FIG. 14.

Figure 14:
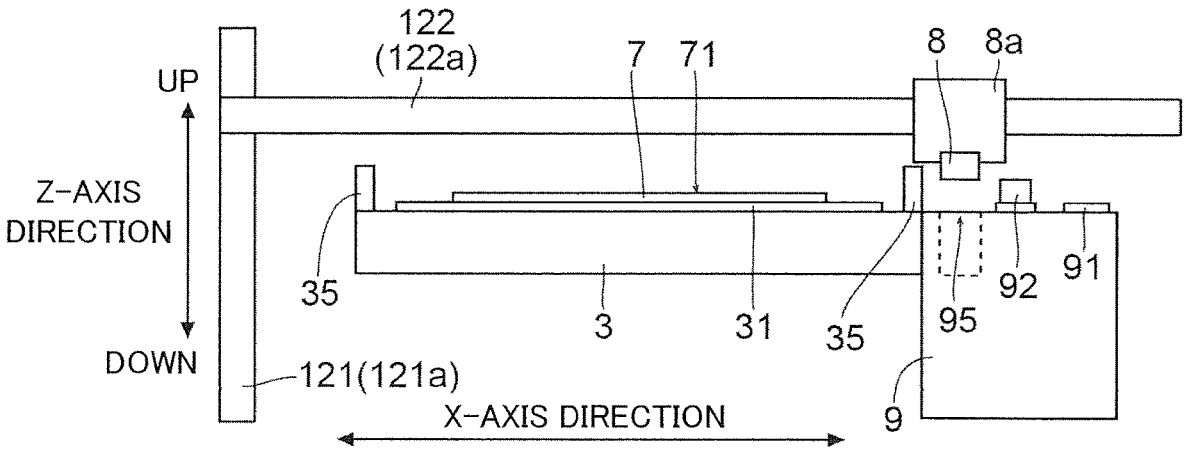
FIG. 14 illustrates a position of the head when the ink ejecting device according to an embodiment performs the flushing process.

Next, the control unit 10 performs the flushing process in the state illustrated in FIG. 14 (step #26). Thus, the ink accumulated in the nozzles 81 is ejected from all the nozzles 81. The ink ejected from the head 8 flows into a waste liquid tank 94 through the opening 95.

When the flushing process ends, the control unit 10 returns the head 8 to the scan start position. At this time, the control unit 10 moves the head 8, in a state (where it is) moved to a position higher than the end position of the guide 35 in the Z-axis direction, in the X-axis direction. Then, the head 8 is placed within the inter-guide range R2 (see FIG. 8). In this manner, when the head 8 is returned to the scan start position after the flushing process, the head 8 and the guide 35 do not contact each other.

(Wiping Process)

Next, a wiping process will be described with reference to FIGS. 15 and 16.

Dust and powder dust adhering to the nozzle surface of the head 8 enter the nozzles 81. In addition, viscosity of the ink accumulated in the nozzles 81 increases with time. These factors cause clogging of the nozzles 81. This leads to a problem of reduced image quality.

In order to avoid such a problem, the control unit 10 performs a wiping process. In the wiping process, the nozzle surface of the head 8 is cleaned. Before the wiping process, a purge process is performed. In the purge process, the ink in the head 8 is forcibly pushed out of the nozzles 81. In this manner, clogging of the nozzles 81 can be avoided. The wiping process (including the purge process) is one of conditioning processes that keeps the nozzles 81 in a normal condition.

Figure 15:
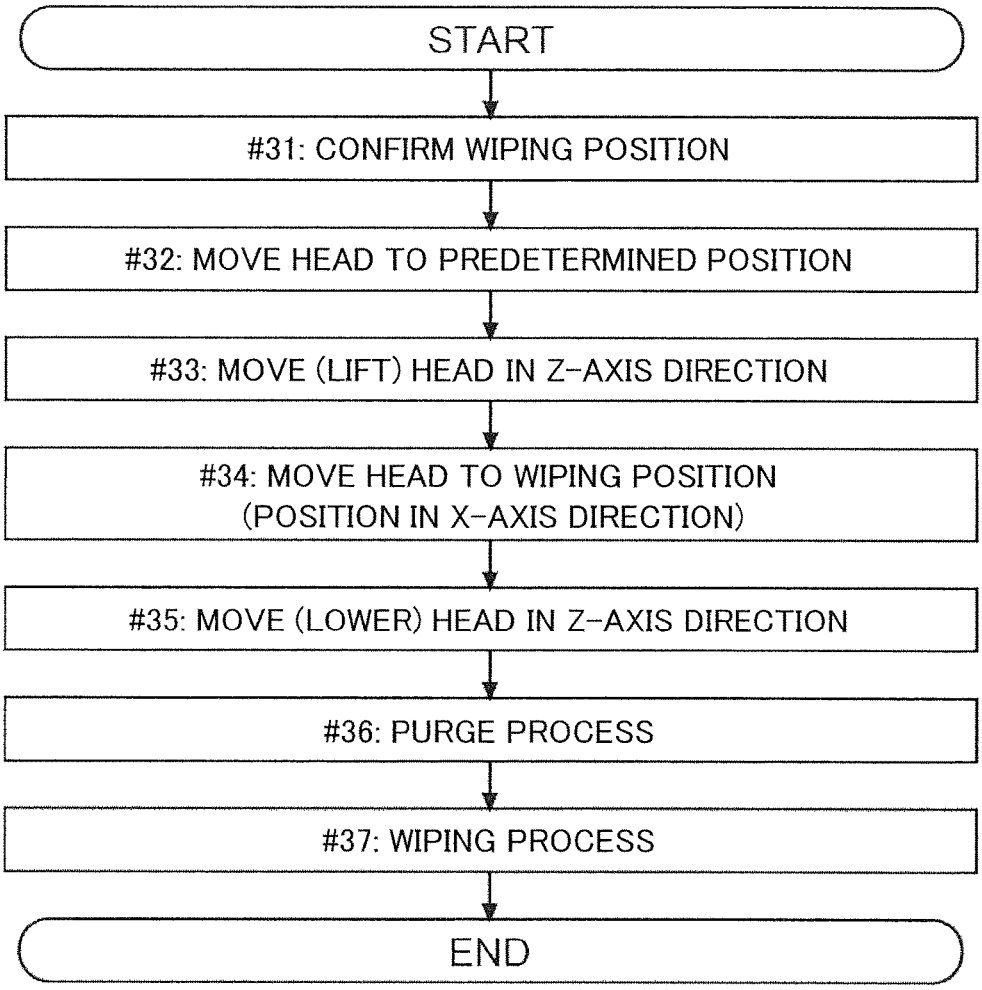
FIG. 15 is a diagram explaining a wiping process performed by the ink ejecting device according to an embodiment.

The control unit 10 performs the process according to the flowchart in FIG. 15 to clean the nozzle surface of the head 8. The process shown in the flowchart in FIG. 15 starts when the control unit 10 determines that a predetermined wiping condition is satisfied.

In order to determine whether the wiping condition is satisfied, the control unit 10 counts the number of times that the conveying device 3 temporarily suspends (the number of stops) the conveyance operation (the operation of repeating the feeding operation and the stop of the feeding operation) to cause the plate device 2 to print on the fabric 7. The count of the number of stops is stored in the storage unit 11. The control unit 10 resets the count of the number of stops each time the number of stops reaches a predetermined number (for example, several times to ten and several times).

Then, the control unit 10 determines that the wiping condition is satisfied each time the number of stops reaches a predetermined number. That is, the control unit 10 performs the wiping process each time the number of stops reaches a predetermined number (the process in the flowchart in FIG. 15 starts).

For example, the predetermined number of times is three. In this case, when the number of stops reaches three, the control unit 10 determines that the wiping condition is satisfied and performs the wiping process. That is, the control unit 10 performs the wiping process once each time the printing by the plate device 2 is performed three times. When the predetermined number of times is set to one, the wiping process is performed each time the conveying device 3 temporarily suspends the conveying operation in order to cause the plate device 2 to print on the fabric 7. In any case, the control unit 10 performs the wiping process when the conveying device 3 temporarily suspends the conveying operation in order to cause the plate device 2 to print on the fabric 7.

The control unit 10 scans with the head 8 when the number of stops reaches a predetermined number. After one scanning event ends (after the head 8 is moved from the scan start position to the scan end position), the control unit 10 subsequently performs the wiping process.

When the operation panel 15 receives a wiping instruction from the user, the control unit 10 may determine that the wiping condition is satisfied. Further, when all the printing of one roll of the fabric 7 ends, the control unit 10 may determine that the wiping condition is satisfied. When all the printing to be performed by the ink ejecting device 1 ends, even before all the printing on one roll of the fabric 7 ends, the control unit 10 may determine that the wiping condition is satisfied.

Further, the control unit 10 may determine that the wiping condition is satisfied when the capping condition is satisfied. That is, the capping condition and the wiping condition may be the same. In this case, the capping process is performed after the wiping process is performed.

If it is determined that the wiping condition is satisfied, the control unit 10 first confirms a wiping position (step #31). The wiping position is stored in the storage unit 11. The wiping position is a position in which the nozzle surface of the head 8 contacts the cleaning member 92. The storage unit 11 stores the position (coordinate) in the X-axis direction of the wiping position and the position (coordinate) in the Z-axis direction of the wiping position.

Next, the control unit 10 controls the X-axis moving mechanism 122 to move the head 8 in the X-axis direction until the head 8 reaches a predetermined position (step #32). The process of step #32 is the same as the process of step #12 illustrated in FIG. 11. That is, when the head 8 is moved to the predetermined position, the state illustrated in the upper diagram of FIG. 12 is obtained.

Next, the control unit 10 controls the Z-axis moving mechanism 121 to adjust the position of the nozzle surface of the head 8 in the Z-axis direction to a position higher than the end position of the guide 35 in the Z-axis direction (step #33). That is, the control unit 10 lifts the head 8.

Next, the control unit 10 controls the X-axis moving mechanism 122 to move the head 8 in the X-axis direction until the head 8 reaches the position of the wiping position in the X-axis direction (step #34). That is, the control unit 10 moves the head 8 toward a placement area of the maintenance device 9 (i.e., the wiping position). As a result, the head 8 is placed in the X-axis direction of the wiping position.

When the head 8 crosses the guide 35, the head 8 moves over the guide 35. That is, as when the head 8 is moved to the capping position, the head 8 and the guide 35 do not contact each other (see the middle diagram of FIG. 12).

Next, the control unit 10 controls the Z-axis moving mechanism 121 to adjust the position of the nozzle surface of the head 8 in the Z-axis direction to a position lower than the end position of the guide 35 in the Z-axis direction (step #35). That is, the control unit 10 lowers the head 8.

At this time, the control unit 10 moves (lowers) the head 8 in the Z-axis direction until the nozzle surface of the head 8 reaches the position of the wiping position in the Z-axis direction. As a result, the nozzle surface of the head 8 contacts the cleaning member 92. A state in which the nozzle surface of the head 8 is at a position in the Z-axis direction of the wiping position is illustrated in FIG. 16.

Figure 16:
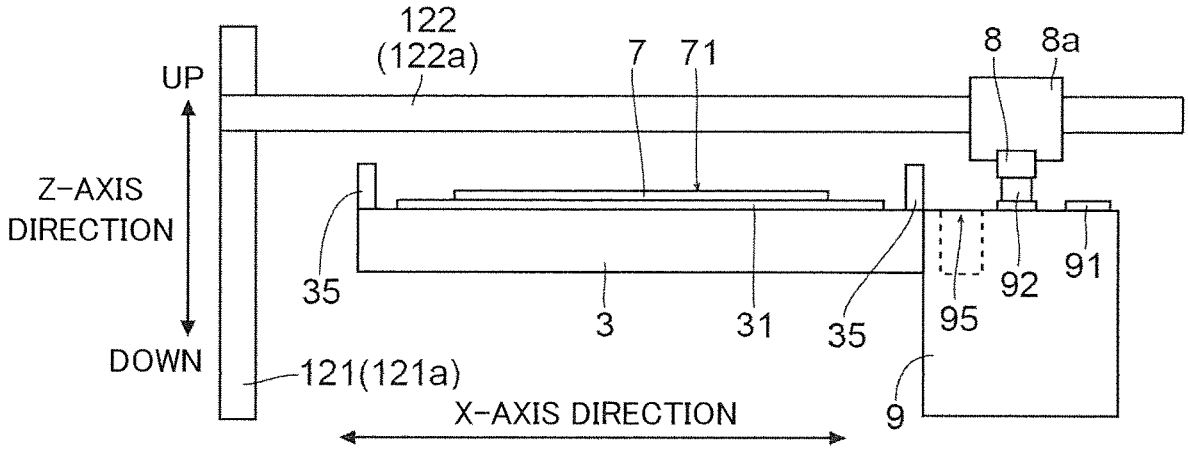
FIG. 16 illustrates a position of the head when the ink ejecting device according to an embodiment performs the wiping process.

Next, the control unit 10 performs the purge process in the state illustrated in FIG. 16 (step #36). The ink ejecting device 1 is provided with a pressure application unit 85 (see FIG. 5). For example, the pressure application unit 85 is a pump. The pressure application unit 85 is provided in an ink supply path to the head 8.

When performing the purge process, the control unit 10 controls the pressure application unit 85 to apply pressure to an ink flow path in the head 8. As a result, the ink in the head 8 is forced out of the nozzles 81. The control unit 10 supplies a cleaning liquid to the cleaning member 92 by using the cleaning unit 93.

In this state, the control unit 10 performs the wiping process by using the cleaning member 92 (step #37). The control unit 10 performs a process of moving the cleaning member 92 in the Y-axis direction as the wiping process. The cleaning member 92 may be made to reciprocate in the Y-axis direction. At this time, the cleaning member 92 is in contact with the nozzle surface of the head 8. Therefore, by moving the cleaning member 92 in the Y-axis direction, it is possible to wipe off dirt (such as ink) attached to the nozzle surface of the head 8. The wiped ink, cleaning liquid, and the like flow down along the cleaning member 92 and are stored in the waste liquid tank 94.

When the wiping process ends, the control unit 10 returns the head 8 to the scan start position. At this time, the control unit 10 moves the head 8, in a state (where it is) moved to a position higher than the end position of the guide 35 in the Z-axis direction, in the X-axis direction. Then, the head 8 is placed within the inter-guide range R2 (see FIG. 8). In this manner, when the head 8 is returned to the scan start position after the wiping process, the head 8 and the guide 35 do not contact each other.

In the present embodiment, as described above, the printing apparatus 100 includes the ink ejecting device 1 and the plate device 2. With this configuration, the printing apparatus 100 provided with both advantages of digital printing and advantages of analog printing is provided. For example, the ink ejecting device 1 is able to print a multi-colored image and a gradation image. On the other hand, the plate device 2 is able to print solid images or the like which tend to have low density and uneven color when printed on the printing by the ink ejecting device 1. In this manner, it is possible to print a high density image on the fabric 7 with high image quality and no color unevenness.

In the present embodiment, as described above, the ink ejecting device 1 is attachable to and detachable from the printing apparatus 100. Thus, the ink ejecting device 1 is able to be easily attached to the printing apparatus 100 as necessary. When the ink ejecting device 1 becomes unnecessary or attachment of the plate device 2 becomes unnecessary, the ink ejecting device 1 may be easily detached from the printing apparatus 100.

Further, the plate device 2 may be detached from the printing apparatus 100, and the ink ejecting device 1 may be attached to the position in which the detached plate device 2 has been placed. Likewise, the ink ejecting device 1 may be detached from the printing apparatus 100, and the plate device 2 may be attached to the position in which the detached ink ejecting device 1 has been placed. In this manner, the placement positions of the ink ejecting device 1 and the plate device 2 may be arbitrarily changed. For example, depending on the image to be printed on the fabric 7, the ink ejecting device 1 may be placed upstream of the plate device 2 in the Y-axis direction (conveyance direction), or the ink ejecting device 1 may be placed downstream of the plate device 2 in the Y-axis direction (conveyance direction).

Since a single ink ejecting device 1 is able to print multi-colored images, it is possible to omit a plurality of plate devices 2 by simply adding a single ink ejecting device 1 to the printing apparatus 100.

Further, in the present embodiment, as described above, the ink ejecting device 1 performs the flushing process when the conveying device 3 temporarily suspends the conveying operation (when the plate device 2 is performing printing). Thus, the image quality is able to be improved while preventing reduced productivity. In addition, since the flushing process is performed each time the conveying device 3 temporarily suspends the conveying operation, clogging of the nozzles 81 is less likely to occur. Further, it is convenient for users that the flushing process is automatically performed without users operating the ink ejecting device 1 (the operation panel 15).

In the present embodiment, as described above, the ink ejecting device 1 performs the wiping process when the conveying device 3 is temporarily suspending the conveying operation (when the plate device 2 is performing printing). Thus, the image quality is able to be improved while preventing reduced productivity. Further, it is convenient for users that the wiping process is automatically performed without users operating the ink ejecting device 1 (the operation panel 15). Here, the time taken for the wiping process is longer than the time taken for the flushing process. For this reason, it is preferable to set the execution frequency of the wiping process to be lower than the execution frequency of the flushing process.

Further, when the wiping process is performed, the cleaning liquid is supplied to the cleaning member 92. Thus, the nozzle surface of the head 8 is able to be cleaned desirably. When the wiping process is performed, the purge process is performed. By performing the purge process, clogged nozzles 81 can be unclogged.

In the present embodiment, as described above, when printing by the ink ejecting device 1 is not performed, the cap 91 is fit into the nozzle surface of the head 8. Thus, even if printing by the ink ejecting device 1 is not performed for a long period of time, drying of the nozzle surface (the ink in the nozzles 81) of the head 8 can be avoided. Further, it is convenient for users that the capping process is automatically performed without users operating the ink ejecting device 1 (the operation panel 15).

In the present embodiment, as described above, the ink ejecting device 1 employs a serial head system, but the head 8 is movable in the Z-axis direction. Therefore, the position of the head 8 in the Z-axis direction is adjustable. For example, the position of the head 8 in the Z-axis direction is able to be adjusted according to the type of the image to be printed on the fabric 7 and the type of the fabric 7. This can further improve the image quality.

When an image that requires fine printing (such as an image of a two-dimensional code) is to be printed on the fabric 7, the head 8 is able to be brought closer to the fabric 7. When an image that does not require fine printing is to be printed on the fabric 7, the head 8 is able to be kept away from the fabric 7.

The head 8 is configured to be movable in the Z-axis direction. Therefore, even if the maintenance device 9 is placed outside the inter-guide range R2 (see FIG. 8), the head 8 and the guide 35 do not contact each other when the head 8 is moved to the area in which the maintenance device 9 is placed. This allows more freedom in the placement of the maintenance device 9.

The embodiment and modifications thereto described herein should be considered in every aspect illustrative and not restrictive. The scope of the present disclosure is defined by the appended claims rather than the explanation of the above embodiment and modifications thereto and includes all modifications made within a sense and scope equivalent to those of the claims.

What is claimed is:

1. An ink ejecting device installed on a conveyance line for a recording medium in a conveying device that conveys the recording medium, the ink ejecting device being installed together with a printing device that performs printing on the recording medium using a printing plate, the ink ejecting device comprising:

a head that performs printing on the recording medium by ejecting ink onto the recording medium from a plurality of nozzles arranged along a Y-axis direction parallel to a direction in which the recording medium is conveyed;

an X-axis moving mechanism that moves the head in an X-axis direction orthogonal to the Y-axis direction on a horizontal plane;

a control unit that controls the X-axis moving mechanism to perform scanning in which the head is moved in the X-axis direction, and causes the head to eject ink during the scanning;

a Z-axis moving mechanism that is controlled by the control unit to move the head in a Z-axis direction orthogonal to the Y-axis and X-axis directions;

a maintenance device that is provided in a movable range of the head in the X-axis direction and outside a range defined between both ends of the conveying device in the X-axis direction, wherein:

the maintenance device is provided at a position lower than positions of ends in the Z-axis direction of edge members respectively provided at the both ends of the conveying device;

the positions of the ends of the edge members are higher than an upper surface of a conveyor belt of the conveying device, which is in contact with the recording medium;

when printing is performed, the nozzles are maintained at a position lower than the positions of the ends of the edge members; and when performing a conditioning process to keep the nozzles in a normal condition using the maintenance device, the control unit moves the nozzles of the head from a position lower than the positions of the ends of the edge members, which is a position of the nozzles when printing is performed, to a position higher than the positions of the ends of the edge members and causes the nozzles to pass in the X-axis direction at a position higher than the positions of the ends of the edge members to reach an area in which the maintenance device is provided at a position lower than the positions of the ends of the edge members.

2. A printing apparatus comprising:

the ink ejecting device according to claim 1;

the conveying device that conveys the recording medium on which printing is performed by the ink ejecting device; and the printing device that performs printing on the recording medium using the printing plate.

3. The printing apparatus according to claim 2, wherein the ink ejecting device is attachable to and detachable from the conveyance line for the recording medium in the conveying device.

4. The printing apparatus according to claim 2, wherein the ink ejecting device is fixed to the conveyance line for the recording medium in the conveying device.

* * * * *